United States Patent [19]

Dantzig et al.

[11] Patent Number: 4,465,118

[45] Date of Patent: Aug. 14, 1984

[54] PROCESS AND APPARATUS HAVING IMPROVED EFFICIENCY FOR PRODUCING A SEMI-SOLID SLURRY

[75] Inventors: Jonathan A. Dantzig, Hamden; Derek E. Tyler, Cheshire, both of Conn.

[73] Assignee: International Telephone and Telegraph Corporation, New York, N.Y.

[21] Appl. No.: 279,917

[22] Filed: Jul. 2, 1981

[51] Int. Cl.[3] ..... B22D 27/02

[52] U.S. Cl. ..... 164/452; 164/467

[58] Field of Search ..... 164/452, 455, 467, 503, 164/507

[56] References Cited

U.S. PATENT DOCUMENTS

| | | | |
|---|---|---|---|
| 2,861,302 | 11/1958 | Mann et al. | 164/504 |
| 2,963,758 | 12/1960 | Pestel et al. | 164/5 |
| 3,268,963 | 8/1966 | Mann | 164/493 |
| 3,902,544 | 9/1975 | Flemings et al. | 164/485 |
| 3,936,298 | 2/1976 | Mehrabian et al. | 148/400 |
| 3,948,650 | 4/1976 | Flemings et al. | 420/590 |
| 3,954,455 | 5/1976 | Flemings et al. | 148/400 |
| 3,995,678 | 12/1976 | Zavaras et al. | 164/468 |
| 4,030,534 | 6/1977 | Ito et al. | 164/504 |
| 4,040,467 | 8/1977 | Alberny et al. | 164/468 |
| 4,042,007 | 8/1977 | Zavaras et al. | 164/468 |
| 4,042,008 | 8/1977 | Alberny et al. | 164/504 |
| 4,229,210 | 10/1980 | Winter et al. | 75/10 R |

FOREIGN PATENT DOCUMENTS

| | | |
|---|---|---|
| 2707774 | 9/1977 | Fed. Rep. of Germany . |
| 1525036 | 9/1978 | United Kingdom . |
| 1525545 | 9/1978 | United Kingdom . |
| 2042385 | 9/1980 | United Kingdom . |

OTHER PUBLICATIONS

Flemings et al., "Rheocasting Processes", *AFS International Cast Metals Journal,* Sep. 1976, pp. 11–22.

Fascetta et al., "Die Casting Partially Solidified High Copper Content Alloys", *AFS Cast Metals Research Journal,* Dec. 1973, pp. 161–171.

Szekely et al., "Electromagnetically Driven Flows In Metals Processing", *Journal of Metals,* Sep. 1976, pp. 6–11.

*Primary Examiner*—Kuang Y. Lin

*Attorney, Agent, or Firm*—James B. Raden; Harold J. Holt

[57] ABSTRACT

A process and apparatus having improved efficiency for forming a semi-solid alloy slurry. A molten metal in a containing device is mixed electromagnetically by a moving, non-zero magnetic field provided over substantially all of a solidification zone within the containing device. The magnetic field causes the shearing of dendrites formed in the solidification zone at a desired shearing rate. The magnetic field is generated by a device supplied with current at a desired line frequency. By operating within a defined range of line frequencies, a desired shear rate for attaining a desired cast structure at reduced levels of power consumption and current can be achieved.

6 Claims, 7 Drawing Figures

PROCESS AND APPARATUS HAVING IMPROVED EFFICIENCY FOR PRODUCING A SEMI-SOLID SLURRY

This invention relates to a process and apparatus having improved efficiency for producing a semi-solid thixotropic alloy slurry for use in such applications as casting and forging.

Methods for producing semi-solid thixotropic alloy slurries known in the prior art include mechanical stirring and inductive electromagnetic stirring. The processes for producing such a slurry with a proper structure require a balance between the shear rate imposed by the stirring and the solidification rate of the material being cast.

The mechanical stirring approach is best exemplified by reference to U.S. Pat. Nos. 3,902,544, 3,954,455, 3,948,650, all to Flemings et al. and 3,936,298 to Mehrabian et al. The mechanical stirring approach is also described in articles appearing in *AFS International Cast Metals Journal,* September, 1976, pages 11–22, by Flemings et al. and *AFS Cast Metals Research Journal,* December, 1973, pages 167–171, by Fascetta et al. In German OLS No. 2,707,774 published Sept. 1, 1977 to Feurer et al., the mechanical stirring approach is shown in a somewhat different arrangement.

In the mechanical stirring process, the molten metal flows downwardly into an annular space in a cooling and mixing chamber. Here the metal is partially solidified while it is agitated by the rotation of a central mixing rotor to form the desired thixotropic metal slurry for casting. The mechanical stirring approaches suffer from several inherent problems. The annulus formed between the rotor and the mixing chamber walls provides a low volumetric flow rate of thixotropic slurry. There are material problems due to the erosion of the rotor. It is difficult to couple mechanical agitation to a continuous casting system.

In the continuous casting processes described in the art, the mixing chamber is arranged above a direct chill casting mold. The transfer of the metal from the mixing chamber to the mold can result in oxide entrainment. This is a particularly acute problem when dealing with reactive alloys such as aluminum which are susceptible to oxidation.

The slurry is thixotropic, thus requiring high shear rates to effect flow into the continuous casting mold. Using the mechanical approach, one is likely to get flow lines due to interrupted flow and/or discontinuous solidification. The mechanical approach is also limited to producing semi-solid slurries which contain from about 30 to 60% solids. Lower fractions of solids improve fluidity but enhance undesired coarsening and dendritic growth during completion of solidification. It is not possible to get significantly higher fractions of solids because the agitator is immersed in the slurry.

In order to overcome the aforenoted problems, inductive electromagnetic stirring has been proposed in U.S. Pat. No. 4,229,210 to Winter et al. In that patent, two electromagnetic stirring techniques are suggested to overcome the limitations of mechanical stirring. Winter et al. use either AC induction or pulsed DC magnetic fields to produce indirect stirring of the solidifying alloy melt. While the indirect nature of this electromagnetic stirring is an improvement over the mechanical process, there are still limitations imposed by the nature of the stirring technique.

With AC inductive atirring, the maximum electromagnetic forces and associated shear are limited to the penetration depth of the induced currents. Accordingly, the section size that can be effectively stirred is limited due to the decay of the induced forces from the periphery to the interior of the melt. This is particularly aggravated when a solidifying shell is present. The inductive electromagnetic stirring process also requires high power consumption and the resistance heating of the stirred metal is significant. The resistance heating in turn increases the required amount of heat extraction for solidification.

The pulsed DC magnetic field technique is also effective; however, it is not as effective as desired because the force field rapidly diverges as the distance from the DC electrode increases. Accordingly, a complex geometry is required to produce the required high shear rates and fluid flow patterns to insure production of slurry with a proper structure. Large magnetic fields are required for this process and, therefore, the equipment is costly and very bulky.

The abovenoted Flemings et al. patents make brief mention of the use of electromagnetic stirring as one of many alternative stirring techniques which could be used to produce thixotropic slurries. They fail, however, to suggest any indication of how to actually carry out such an electromagnetic stirring approach to produce such a slurry. The German patent publication to Feurer et al. suggests that it is also possible to arrange induction coils on the periphery of the mixing chamber to produce an electromagnetic field so as to agitate the melt with the aid of the field. However, Feurer et al. does not make it clear whether or not the electromagnetic agitation is intended to be in addition to the mechanical agitation or to be a substitute therefor. In any event, it is clear that Feurer et al. is suggesting merely an inductive type electromagnetic stirring approach.

There is a wide body of prior art dealing with electromagnetic stirring techniques applied during the casting of molten metals and alloys. U.S. Pat. Nos. 3,268,963 to Mann, 3,995,678 to Zavaras et al., 4,030,534 to Ito et al., 4,040,467 to Alherny et al., 4,042,007 to Zavaras et al., and 4,042,008 to Alherny et al., as well as an article by Szekely et al. entitled "Electromagnetically Driven Flows in Metals Processing", September, 1976, *Journal of Metals,* are illustrative of the art with respect to casting metals using inductive electromagnetic stirring provided by surrounding induction coils.

In order to overcome the disadvantages of inductive electromagnetic stirring, it has been found that electromagnetic stirring can be made more effective, with a substantially increased productivity and with a less complex application to continuous type casting techniques, if a magnetic field which moves transversely of the mold or casting axis such as a rotating field is utilized.

The use of rotating magnetic fields for stirring molten metals during casting is known as exemplified in U.S. Pat. Nos. 2,963,758 to Pestel et al., and 2,861,302 to Mann et al. and in U.K. Pat. Nos. 1,525,036 and 1,525,545. Pestel et al. disclose both static casting and continuous casting wherein the molten metal is electromagnetically stirred by means of a rotating field. One or more multipoled motor stators are arranged about the mold or solidifying casting in order to stir the molten metal to provide a fine grained metal casting. In the continuous casting embodiment disclosed in the patent to Pestel et al., a 6 pole stator is arranged about the mold and two 2 pole stators are arranged sequentially thereafter about the solidifying casting.

The disadvantages associated with the prior art approaches for making thixotropic slurries utilizing either mechanical agitation or inductive electromagnetic stirring have been overcome in accordance with the invention disclosed in U.S. patent application Ser. No. 469,486, filed Feb. 24, 1983, continuation of abandoned application Ser. No. 15,250, filed Feb. 26, 1979 to Winter et al. and assigned to the assignee of the instant application. In this application, a rotating magnetic field generated by a two pole multi-phase motor stator is used to achieve the required high shear rates for producing thixotropic semi-solid alloy slurries to be used in slurry casting.

In U.S. patent application Ser. No. 184,089, filed Sept. 4, 1980 to Winter et al., which is a continuation of U.S. patent application Ser. No. 15,059, filed Feb. 26, 1979, a duplex mold is disclosed for use in the above-noted Winter et al. process and apparatus for forming a thixotropic semi-solid alloy slurry. An insulating band for controlling the initial solidification of an ingot shell, which may be used in conjunction with the above-noted Winter et al. process and apparatus, is disclosed in U.S. patent application Ser. No. 258,232, filed Apr. 27, 1981 to Winter et al.

The present invention comprises a process and apparatus having improved efficiency for forming a semi-solid thixotropic alloy slurry. The molten metal in a containing device, such as a mold, is mixed electromagnetically by a moving, non-zero magnetic field provided over substantially all of a solidification zone within the containing device. It has been found that by controlling the line frequency used to generate the magnetic field as a function of the effective cross section diameter of the slurry and the physical properties of the containing device, the efficiency of the proces is improved and the power consumption required to obtain a magnetic field which in turn produces a desired shearing rate can be reduced.

In accordance with this invention, it has been found that for a slurry having an effective cross section diameter in the range up to about 2 inches, the frequency can be determined by the equation:

$$f = x\left\{\left[\frac{-578.7\times10^{-5}\ \text{in}^{-1}}{\Delta} - 148\ (\text{in}\cdot\text{sec})^{-1}\right]D + \left[\frac{1214.7\times10^{-5}}{\Delta} + 589\ \text{sec}^{-1}\right]\right\};$$

and for a slurry having an effective cross section diameter greater than about 2 inches, the frequency can be determined by the equation:

$$f = y[0.136\times10^{5}(\text{in}\cdot\text{sec}^{2})^{-1}(\Delta) - 68.7(\text{in}\cdot\text{sec})^{-1}]D + [-2.27\times10^{5}\text{sec}^{-2}(\Delta) + 478\ \text{sec}^{-1}]$$

where x = from about 0.75 to about 1.25 y = from about 0.5 to about 1.5

D = effective cross section diameter of slurry $\Delta = \sigma\mu_o t^2$ $\sigma$ = electrical conductivity of containing device $\mu_o$ = magnetic permeability of containing device t = thickness of containing device.

Accordingly, it is an object of this invention to provide a process and apparatus having improved efficiency for casting a semi-solid thixotropic alloy slurry.

It is a further object of this invention to provide a process and apparatus as above wherein the power consumption required to obtain a desired shearing rate for any level of magnetic induction can be reduced.

These and other objects will become more apparent from the following description and drawings.

Embodiments of the casting process and apparatus according to this invention are shown in the drawings wherein like numerals depict like parts.

In the background of this application, there have been described a number of techniques for forming semi-solid thixotropic metal slurries for use in slurry casting. Slurry casting as the term is used herein refers to the formation of a semi-solid thixotropic metal slurry, directly into a desired structure, such as a billet for later processing, or a die casting formed from the slurry.

This invention is principally intended to provide slurry cast material for immediate processing or for later use in various applications of such material, such as casting and forging. The advantages of slurry casting have been amply described in the prior art. Those advantages included improved casting soundness as compared to conventional die casting. This results because the metal is partially solid as it enters a mold and, hence, less shrinkage porosity occurs. Machine component life is also improved due to reduced erosion of dies and molds and reduced thermal shock associated with slurry casting.

The metal composition of a thixotropic slurry comprises primary solid discrete particles and a surrounding matrix. The surrounding matrix is solid when the metal composition is fully solidified and is liquid when the metal composition is a partially solid and partially liquid slurry. The primary solid particles comprise degenerate dendrites or nodules which are generally spheroidal in shape. The primary solid particles are made up of a single phase or a plurality of phases having an average composition different from the average composition of the surrounding matrix in the fully solidified alloy. The matrix itself can comprise one or more phases upon further solidification.

Conventionally solidified alloys have branched dendrites which develop interconnected networks as the temperature is reduced and the weight fraction of solid increases. In contrast, thixotropic metal slurries consist of discrete primary degenerate dendrite particles separated from each other by a liquid metal matrix, potentially up to solid fractions of 80 weight percent. The primary solid particles are degenerate dendrites in that they are characterized by smoother surfaces and a less branched structure than normal dendrites, approaching a spheroidal configuration. The surrounding solid matrix is formed during solidification of the liquid matrix subsequent to the formation of the primary solids and contains one or more phases of the type which would be obtained during solidification of the liquid alloy in a more conventional process. The surrounding solid matrix comprises dendrites, single or multi-phased compounds, solid solution, or mixtures or dendrites, and/or compounds, and/or solid solutions.

Figure 1:
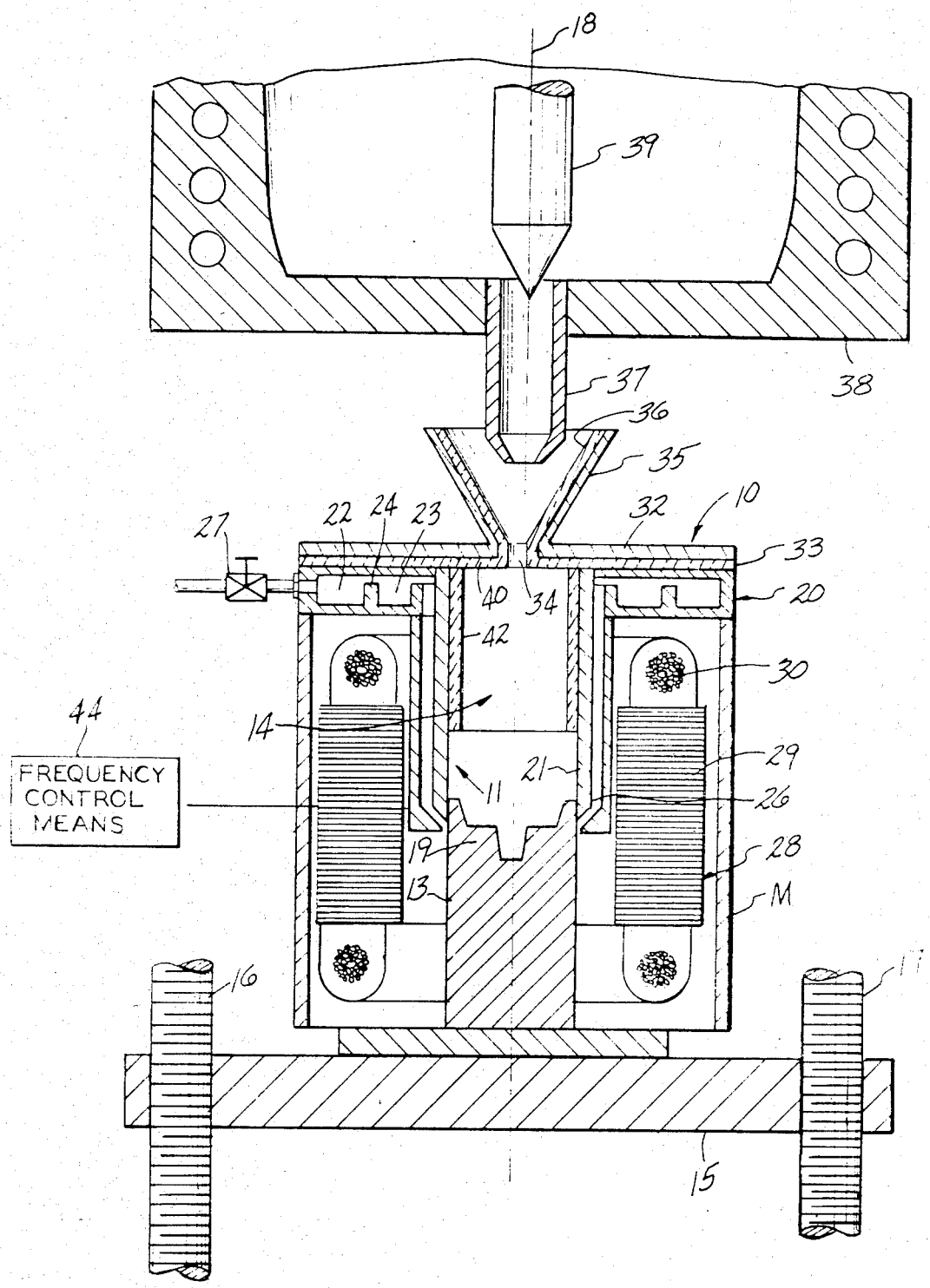
FIG. 1 is a schematic representation in partial cross section of an apparatus for casting a thixotropic semi-solid metal slurry.
Figure 2:
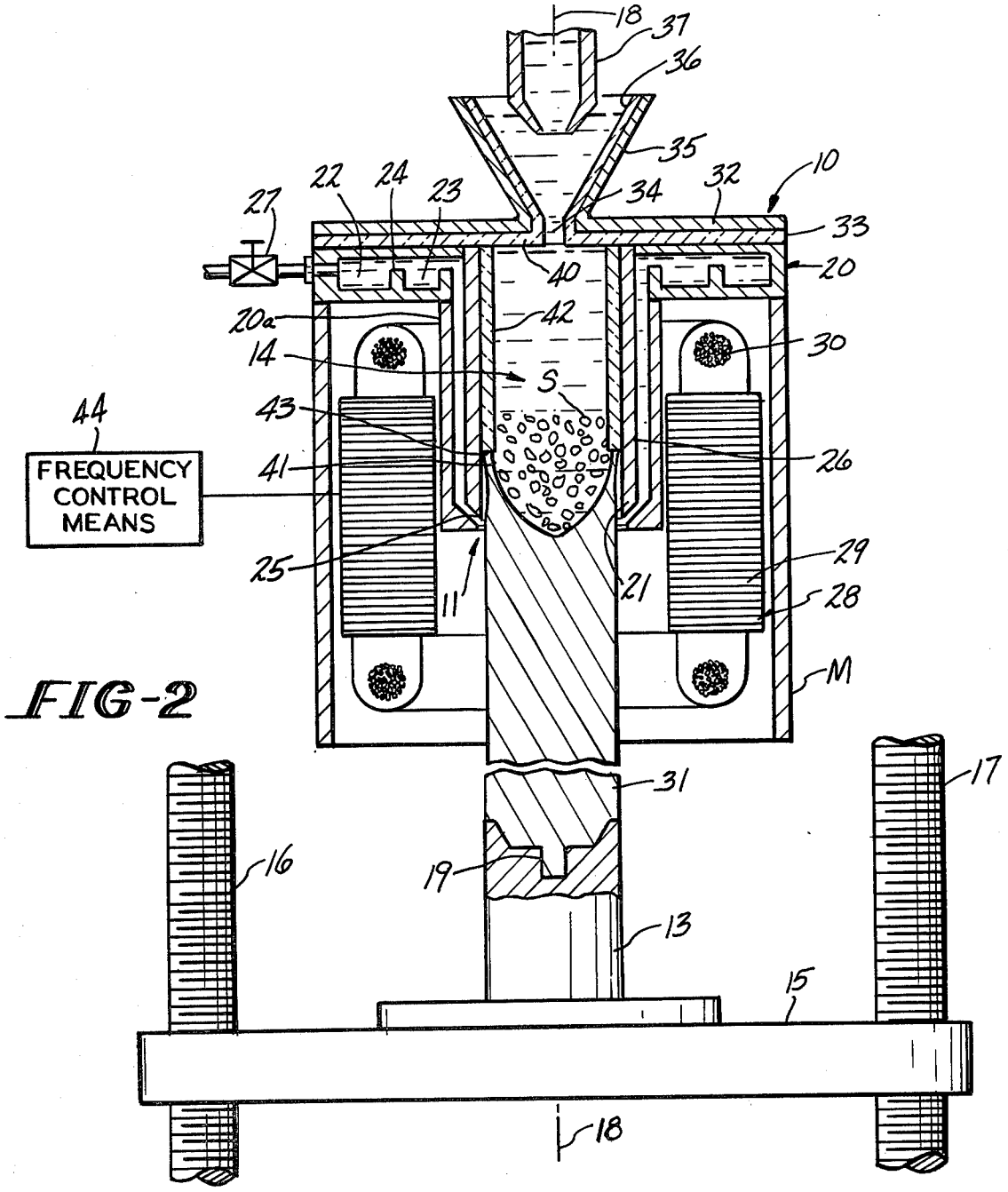
FIG. 2 is a schematic representation in partial cross section of the apparatus of FIG. 1 during a casting operation.

Referring to FIGS. 1 and 2, an apparatus 10 for continuously or semi-continuously slurry casting thixotropic metal slurries is shown. The cylindrical mold 11 is adapted for such continuous or semi-continuous slurry casting. The mold 11 may be formed of any desired non-magnetic material such as austenitic stainless steel, cooper, copper alloy, aluminum, aluminum alloys, or the like.

Figure 3:
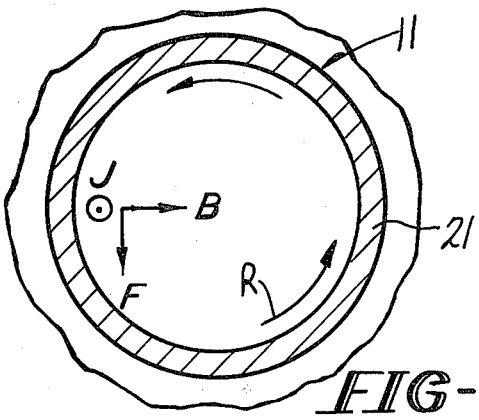
FIG. 3 is a schematic view of the instantaneous fields and forces which cause the molten metal to rotate.
Figure 4:
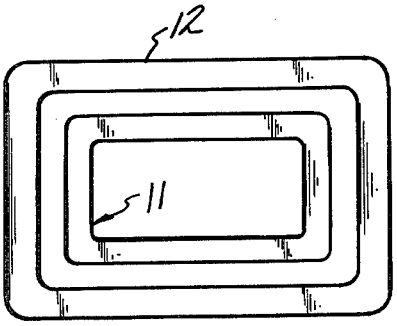
FIG. 4 is a schematic bottom view of a non-circular mold and induction motor stator arrangement in accordance with another embodiment of this invention.

Referring to FIG. 3, it can be seen that the mold wall 13 may be cylindrical in nature. The apparatus 10 and process of this invention are particularly adapted for making cylindrical ingots having a cross section diameter D, utilizing a conventional two pole polyphase induction motor stator for stirring. However, it is not limited to the formation of a cylindrical ingot cross section since it is possible to achieve a transversely or circumferentially moving magnetic field with a non-circularly cylindrical mold arrangement 11 as in FIG. 4. In the embodiment of FIG. 4, the mold 11 has a rectangular cross section surrounded by a polyphase rectangular induction motor stator 12. The magnetic field moves or traverses around the mold 11 in a direction normal to the longitudinal axis of the casting which is being made. The rectangular casting being made has an effective cross section diameter D. As used herein, the phrase effective cross section diameter for a non-circular cross section casting means the shortest line from one periphery to an opposite periphery that passes through the geometric center of the casting. For circular cross section castings, the effective cross section diameter is the same as the diameter of the circular casting. At this time, the preferred embodiment of the invention is in reference to the use of a cylindrical mold 11.

The bottom block 13 of the mold 11 is arranged for movement away from the mold as the casting forms a solidifying shell. The movable bottom block 13 comprises a standard direct chill casting type bottom block. It is formed of metal and is arranged for movement between the position shown in FIG. 1 wherein it sits up within the confines of the mold cavity 14 and a position away from the mold 11 as shown in FIG. 2. This movement is achieved by supporting the bottom block 13 on a suitable carriage 15. Lead screws 16 and 17 or hydraulic means are used to raise and lower the bottom block 13 at a desired casting rate in accordance with conventional practice. The bottom block 13 is arranged to move axially along the mold axis 18. It includes a cavity 19 into which the molten metal is initially poured and which provides a stabilizing influence on the resulting casting as it is withdrawn from the mold 11.

A cooling manifold 20 is arranged circumferentially around the mold wall 21. The particular manifold shown includes a first input chamber 22, a second chamber 23 connected to the first input chamber by a narrow slot 24. A coolant jacket sleeve **20*a* formed from a non-magnetic material is attached to the manifold 20. A discharge slot 25 is defined by the gap between the coolant jacket sleeve 20*a* and the outer surface 26 of the mold 11. A uniform curtain of coolant, preferably water, is provided about the outer surface 26 of the mold 11. The coolant serves to carry heat away from the molten metal via the inner wall of mold 11. The coolant axis through slot 25 discharging directly against the solidifying ingot 31. A suitable valving arrangement 27 is provided to control the flow rate of the water or other coolant discharged in order to control the rate at which the slurry S solidifies. In the apparatus 10 a manually operated valve 27** is shown; however, if desired this could be an electrically operated valve.

The molten metal which is poured into the mold 11 is cooled under controlled conditions by means of the water sprayed upon the outer surface 26 of the mold 11 from the encompassing manifold 20. By controlling the rate of water flow against the mold surface 26, the rate of heat extraction from the molten metal within the mold 11 is in part controlled.

In order to provide a means for stirring the molten metal within the mold 11 to form the desired thixotropic slurry, a two pole multi-phase induction motor stator 28 is arranged surrounding the mold 11. The stator 28 is comprised of iron laminations 29 about which the desired windings 30 are arranged in a conventional manner to preferably provide a three-phase induction motor stator. The motor stator 28 is mounted within a motor housing M. Although any suitable means for providing power and current at different frequencies and magnitudes may be used, the power and current are preferably supplied to stator 28 by a variable frequency generator 44. The manifold 20 and the motor stator 28 are arranged concentrically about the axis 18 of the mold 11 and casting 31 formed within it.

It is preferred to utilize a two pole three-phase induction motor stator 28. One advantage of the two pole motor stator 28 is that there is a non-zero field across the entire cross section of the mold 11. It is, therefore, possible with this invention to solidify a casting having the desired slurry cast structure over its full cross section.

A partially enclosing cover 32 is utilized to prevent spillout of the molten metal and slurry S due to the stirring action impaired by the magnetic field of the motor stator 28. The cover 32 comprises a metal plate arranged above the manifold 20 and separated therefrom by a suitable insulating liner 33. The cover 32 includes an opening 34 through which the molten metal flows into the mold cavity 14. Communicating with the opening 34 in the cover is a funnel 35 for directing the molten metal into the opening 34. An insulating liner 36 is used to protect the metal funnel 35 and the opening 34. As the thixotropic metal slurry S rotates within the mold 11, centrifugal forces in the cavity cause the metal to try to advance up the mold wall 21. The cover 32 with its ceramic lining 33 prevents the metal slurry S from advancing or spilling out of the mold 11 cavity and causing damage to the apparatus 10 and the casting. The funnel portion 35 of the cover 32 also serves as a reservoir of molten metal to keep the mold 11 filled in order to avoid the formation of a U-shaped cavity in the end of the casting due to centrifugal forces.

Situated directly above the funnel 35 is a downspout 37 through which the molten metal flows from a suitable furnace 38. A valve member 39 associated in a coaxial arrangement with the downspout 37 is used in accordance with conventional practice to regulate the flow of molten metal into the mold 11. The furnace 38 may be of any conventional design.

Referring again to FIG. 3, a further advantage of the rotary magnetic field stirring approach is illustrated. In accordance with the Flemings right-hand rule, for a given current J in a direction normal to the plane of the drawing and magnetic flux vector B extending radially inwardly of the mold 11, the magnetic stirring force vector F extends generally tangentially of the mold wall 21. This sets up within the mold cavity a rotation of the molten metal in the direction of arrow R which generates a desired shear for producing the thixotropic slurry S. The force vector F is also tangential to the heat extraction direction and is, therefore, normal to the direction of dendrite growth. By obtaining a desired average shear rate over the solidification range, i.e. from the center of the slurry to the inside of the mold wall, improved shearing of the dendrites as they grow may be obtained. This improves the quality of the slurry cast structure.

It is preferred that the stirring force field generated by the stator 28 extend over the full solidification zone of molten metal and thixotropic metal slurry S. Otherwise, the structure of the casting will comprise regions within the field of the stator 28 having a slurry cast structure and regions outside the stator field tending to have a non-slurry cast structure. In the embodiments of FIGS. 1 and 2, the solidification zone preferably comprises the sump of molten metal and slurry S within the mold 11 which extends from the top surface 40 to the solidification front 41 which divides the solidified casting 31 from the slurry S. The solidification zone extends at least from the region of the initial onset of solidification and slurry formation in the mold cavity 14 to the solidification front 41.

Under normal solidification conditions, the periphery of the ingot 31 will exhibit a columnar dendritic grain structure. Such a structure is undesirable and detracts from the overall advantages of the slurry cast structure which occupies most of the ingot cross section. In order to eliminate or substantially reduce the thickness of this outer dendritic layer in accordance with this invention, the thermal conductivity of the upper region of the mold 11 is reduced by means of a partial mold liner 42 formed from an insulator such as a ceramic. The ceramic mold liner 42 extends from the insulating liner 33 of the mold cover 32 down into the mold cavity 14 for a distance sufficient so that the magnetic stirring force field of the two pole motor stator 28 is intercepted at least in part by the partial ceramic mold liner 42. The ceramic mold liner 42 is a shell which conforms to the internal shape of the mold 11 and is held to the mold wall 21. The mold 11 comprises a duplex structure including a low heat conductivity upper portion defined by the ceramic liner 42 and a high heat conductivity portion defined by the exposed portion of the mold wall 21.

The liner 42 postpones solidification until the molten metal is in the region of the strong magnetic stirring force. The low heat extraction rate associated with the liner 42 generally prevents solidification in that portion of the mold 11. Generally, solidification does not occur except towards the downstream end of the liner 42 or just thereafter. This region 42 or zone of low thermal conductivity thereby helps the resultant slurry cast ingot 31 to have a degenerate dendritic structure throughout its cross section even up to its outer surface.

Figure 6:
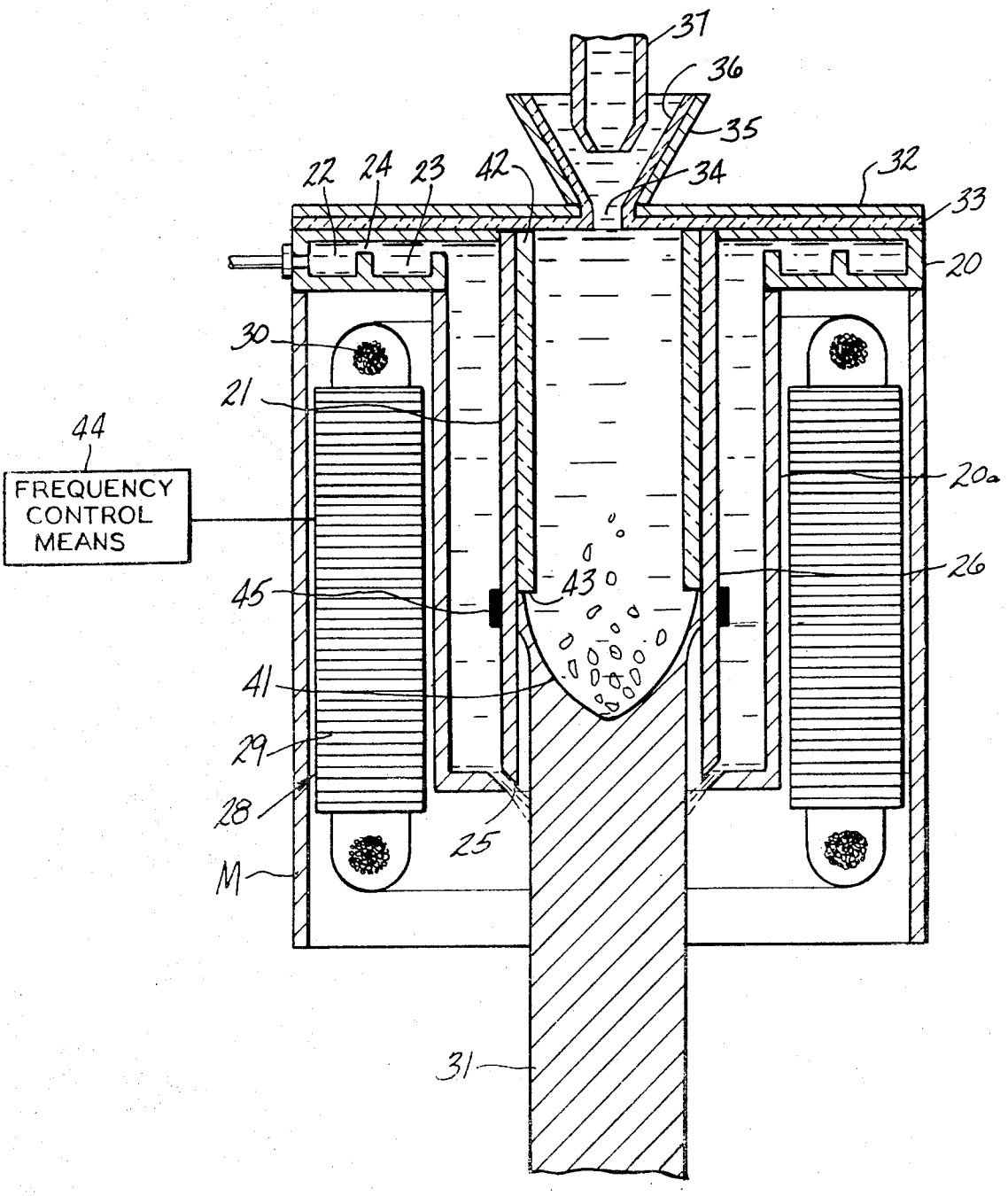
FIG. 6 is a schematic representation in partial cross section of an apparatus for casting a thixotropic semi-solid metal slurry having an insulating band to control initial solidification of the ingot shell.

If desired, the initial solidification of the ingot shell may be further controlled by moderating the thermal characteristics of the casting mold as discussed in copending application Ser. No. 258,232 to Winter et al. In a preferred manner, this is achieved by selectively applying a layer or band of thermally insulating material 45 on the outer wall or coolant side 26 of the mold 11 as shown in FIG. 6. The thermal insulating layer or band 45 retards the heat transfer through mold 11 and thereby tends to slow down the solidification rate and reduce the inward growth of solidification.

Below the region of controlled thermal conductivity, the normal type of water cooled metal casting mold wall 21 is present. The high heat transfer rates associated with this portion of the mold 11 promote ingot shell formation. However, because of the zone of low heat extraction rate, even the peripheral shell of the casting 31 may consist of degenerate dendrites in a surrounding matrix.

It is preferred in order to form the desired slurry cast structure at the surface of the casting to effectively shear any initial solidified growth from the mold liner 42. This can be accomplished by insuring that the field associated with the motor stator 28 extends over at least that portion at which solidification is first initiated.

The dendrites which initially form normal to the periphery of the casting mold 11 are readily sheared off due to the metal flow resulting from the rotating magnetic field of the induction motor stator 28. The dendrites which are sheared off continue to be stirred to form degenerate dendrites until they are trapped by the solidfying interface 41. Degenerate dendrites can also form directly within the slurry because the rotating stirring action of the melt does not permit preferential growth of dendrites. To insure this, the stator 28 length should preferably extend over the full length of the solidification zone. In particular, the stirring force field associated with the stator 28 should preferably extend over the full length and cross section of the solidification zone with a sufficient magnitude to generate the desired shear rates.

To form a slurry casting 31 utilizing the apparatus 10 of FIGS. 1 and 2, molten metal is poured into the mold cavity 14 while the motor stator 28 is energized by a suitable three-phase AC current of a desired magnitude and frequency. In the preferred embodiment, variable frequency generator 44 supplies power to the stator. After the molten metal is poured into the mold cavity, it is stirred continuously by the rotating magnetic field produced by the motor stator 28. Solidification begins from the mold wall 21. The highest shear rates are generated at the stationary mold wall 21 or at the advancing solidification front 41. By properly controlling the rate of solidification by any desired means as are known in the prior art, the desired thixotropic slurry S is formed in the mold cavity 14. As a solidifying shell is formed on the casting 31, the bottom block 13 is withdrawn downwardly at a desired casting rate.

Figure 5:
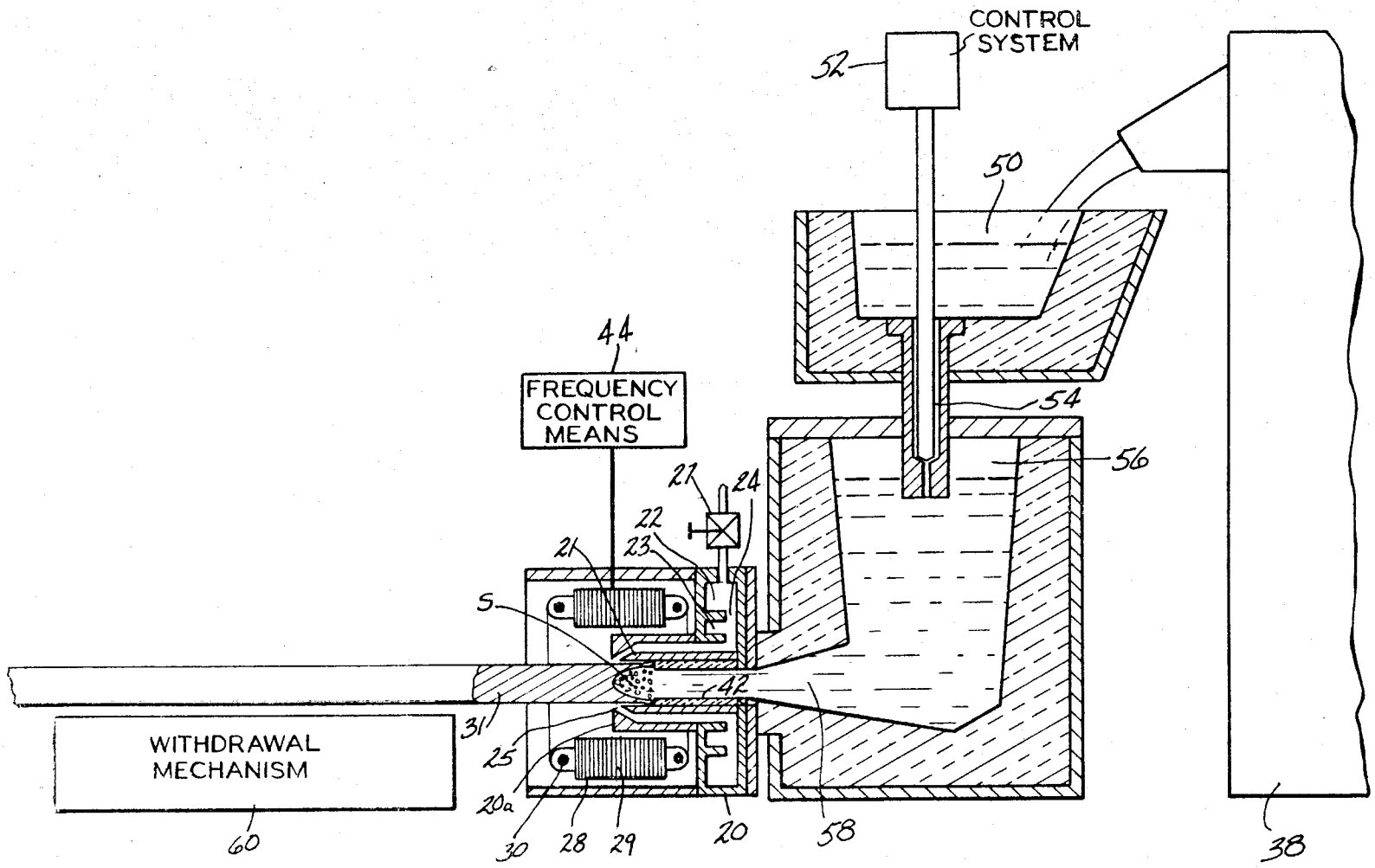
FIG. 5 is a schematic representation in partial cross section of an apparatus for casting a thixotropic semo-solid metal slurry in a horizontal direction.

In a preferred embodiment, a horizontal casting system such as that shown in FIG. 5, is used to produce the slurry cast material. The mold 11, the cooling manifold arrangement 20, and the stator arrangement 28 are the same as that previously described except that they are oriented so the casting is withdrawn horizontally. The molten material supply system comprises the partially shown furnace 38, trough 50, molten metal flow control system or valve 52 which controls the flow of molten material from the trough 50 through the downspout 54 into the tundish 56. The control system 52 controls the height of the molten material in the tundish 56. Alternatively, molten metal may be supplied from the furnace 38 directly into the tundish 56. The molten material exits from the tundish horizontally via conduit 58 which is in direct communication with the entrance to casting mold 11. The solidifying casting or ingot 31 is withdrawn by withdrawal mechanism 60. The withdrawal mechanism 60 provides the drive to the casting or ingot 31 for withdrawing it from the mold section. The flow rate of molten material into mold 11 is controlled by the extraction of casting or ingot 31. Any suitable conventional withdrawal mechanism may be utilized.

The shear rates which are obtainable with the process and apparatus 10 are much higher than those reported for the mechanical stirring process over much larger cross-sectional areas. These high shear rates can be extended to the center of the casting cross section even when the solid shell of the solidifying slurry S is already present.

The induction motor stator 28 which provides the stirring force needed to produce the degenerate dendrite slurry cast structure can be readily placed either above or below the primary cooling manifold 20 as desired. Preferably, however, the induction motor stator 28 and mold 11 are located above the cooling manifold 20.

In accordance with the instant invention, two competing processes, shearing and solidification, are controlling. The shearing produced by the electromagnetic process and apparatus of this invention can be made equivalent to or greater than that obtainable by mechanical stirring.

It has been found that such governing parameters for the process as the magnetic induction field rotation frequency and the physical properties of the molten metal combine to determine the resulting motions. The contribution of the above properties of both the process and melt can be summarized by the formation of two dimensional groups, namely $\beta$ and N as follows:

$$\beta = \sqrt{j2\pi f\sigma\mu_o R^2} \tag{1}$$

$$N = \frac{\sigma R^2 \langle B_r \rangle_o^2}{\eta_o} \tag{2}$$

where $j=\sqrt{-1}$ f=line frequency $\sigma$=melt electrical conductivity $\mu_o$=magnetic permeability R=melt radius $\langle B_r \rangle_o$=radial magnetic induction at the mold wall $\eta_o$=melt viscosity.

As used herein, the term line frequency means the frequency of the polyphase current being applied to the stator. The first group, $\beta$, is a measure of the field geometry effects, while the second group, N, appears as a coupling coefficient between the magnetomotive body forces and the associated velocity field. The computed velocity and shearing fields for a single value of $\beta$ as a function of the parameter N can be determined.

From these determinations it has been found that the shear rate is a maximum toward the outside of the mold. This maximum shear rate increases with increasing N. It has been recognized that the shearing is produced in the melt because the peripheral boundary or mold wall is rigid. Therefore, when a solidifying shell is present, shear stresses in the melt should be maximal at the liquid-solid interface 41. Further, because there are always shear stresses at the advancing interface 41, it is possible to make a full section ingot 31 with the appropriate degenerate dendritic slurry cast structure.

In accordance with the instant invention, it has been surprisingly found that operating within a defined range of line frequencies can produce a desired shear rate for attaining a desired cast structure at reduced levels of power consumption and current. It has also been unexpectedly found that efficiency is improved due to reduced heating losses in the stator.

The defined range of line frequencies can be predicted from the physical properties of the mold and the effective cross section diameter of the solidifying slurry in accordance with the following equations:

for an effective cross section diameter D in the range of up to about 2 inches, $$f = x\left\{\left[\frac{-578.7\times10^{-5}\,\text{in}^{-1}}{\Delta} - 148\,(\text{in}\cdot\text{sec})^{-1}\right]D + \left[\frac{1214.7\times10^{-5}}{\Delta} + 589\,\text{sec}^{-1}\right]\right\} \tag{3, 4}$$

where x=from about 0.75 to 1.25

$$\Delta = \sigma\mu_o t^2 \tag{4}$$

$\sigma$=electrical conductivity of the mold material $\mu_o$=magnetic permeability of the mold material t=mold thickness; and for an effective cross section diameter D greater than about 2.0 inches, $$f = y\{[0.136\times10^5\,(\text{in}\cdot\text{sec}^2)^{-1}\,(\Delta) - 68.7\,(\text{in}\cdot\text{sec})^{-1}]D + [-2.27\times10^5\,\text{sec}^{-2}\,(\Delta) + 478\,\text{sec}^{-1}]\} \tag{5}$$

where y=from about 0.5 to about 1.5. In a preferred embodiment, x=from about 0.8 to 1.2 and Y=from about 0.75 to 1.25.

The parameter $\Delta$ described by equation (4) and used in equations (3) and (5) fully describes the effect of the mold on the stirring of the melt. The mold affects the stirring of the melt in that it absorbs some of the magnetic field.

The ability to define the range of operating line frequencies enables the quality of the structures being produced to be markedly improved in that the degenerate dendrites become more spheroidal in shape as a result of the increased stirring effect at reduced levels of power consumption and current. It also is an important guide in the selection of a frequency to minimize stator heating while generating a desired average shear rate for any specific casting size. Stator heating being determined within a given stator by the magnetizing current.

In the embodiments of FIGS. 1, 2, 5 and 6, variable frequency generator 44 provides current at a particular line frequency to stator 28 which in turn produces a moving, non-zero magnetic field at a desired frequency over substantially all of the solidification zone. The magnetic field causes the mixing of the molten metal and the shearing, at a desired rate, of the dendrites formed in the solidification zone. By using variable frequency generator 44 to control the line frequency in accordance with either equation (3) or equation (5), the improved efficiency, reduced power consumption and minimization of wasteful stator heating can be achieved.

Figure 7:
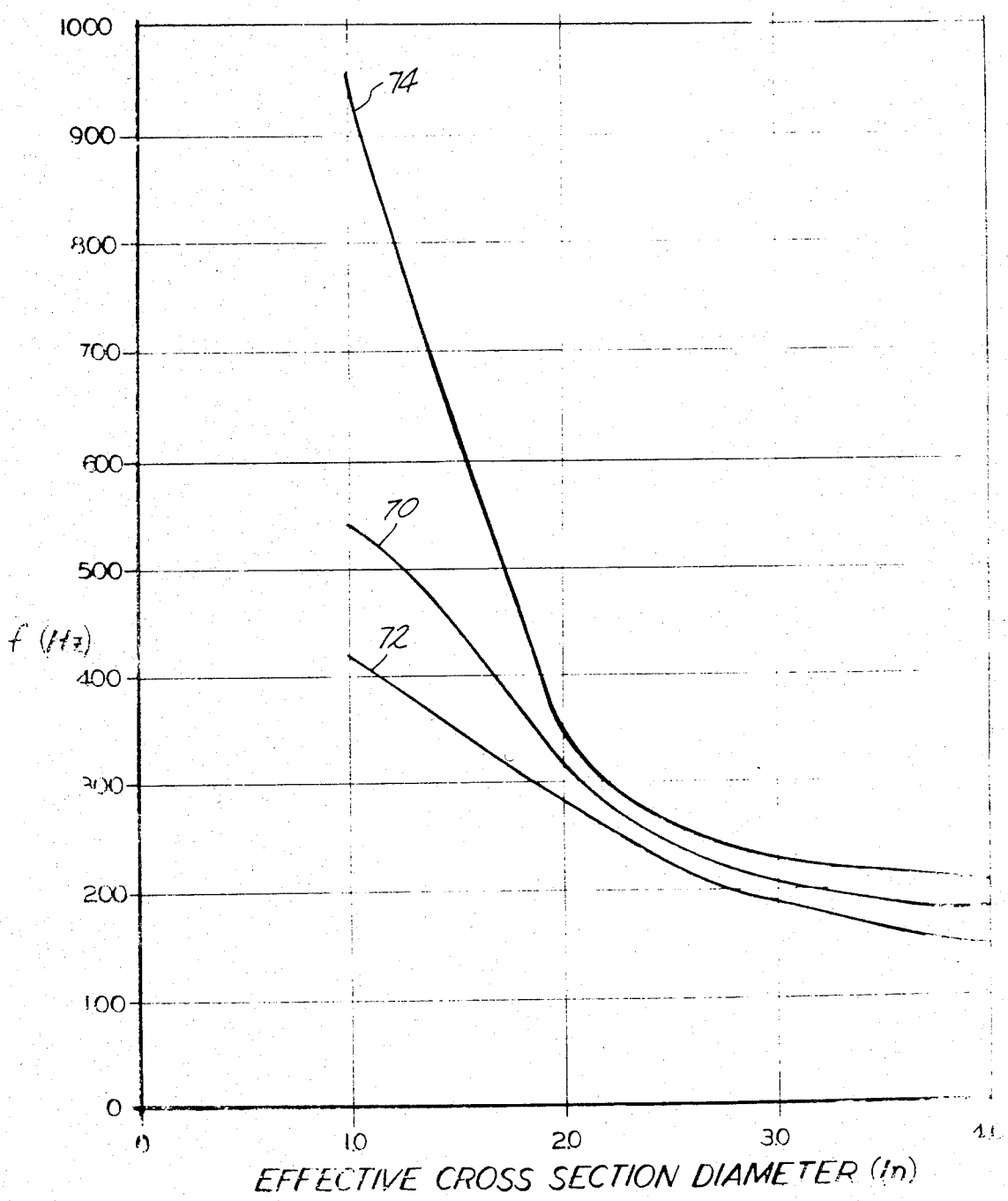
FIG. 7 is a graph showing examples of frequency vs. casting diameter for different types of molds.

FIG. 7 shows examples of desired frequencies for producing reduced power consumption vs. the effective cross section diameter of an aluminum alloy slurry being cast for different types of molds. Line 70 represents the frequency curve for different diameter slurries being cast in a ¼ inch thick aluminum mold. Line 72 represents the frequency curve for different diameter slurries being cast in a ¼ inch thick copper mold. Line 74 represents the frequency curve for different diameter slurries being cast in a ¼ inch thick austenitic stainless steel mold.

Suitable shear rates for carrying out the process of this invention comprise from at least about 400 sec.$^{-1}$ to about 1500 sec.$^{-1}$ and preferably from at least about 500 sec.$^{-1}$ to about 1200 sec.$^{-1}$. For aluminum and it alloys, a shear rate of from about 700 sec.$^{-1}$ to about 1100 sec.$^{-1}$ has been found desirable.

The average cooling rates through the solidification temperature range of the molten metal in the mold should be from about 0.1° C. per minute to about 1000° C. per minute and preferably from about 10° C. per minute to about 500° C. per minute. For aluminum and its alloys, an average cooling rate of from about 40° C. per minute to about 500° C. per minute has been found to be suitable. The efficiency of the magnetohydrodynamic stirring allows the use of higher cooling rates than with prior art stirring processes. Higher cooling rates yield highly desirable finer grain structures in the resulting casting. Further, for continuous slurry casting higher throughput follows from the use of higher cooling rates.

The parameter $|\beta^2|$ ($\beta$ defined by equation (1)) for carrying out the process of this invention should comprise from about 1 to about 10 and preferably from about 3 to about 7.

The parameter in N (defined by equation (2)) for carrying out the process of this invention should comprise from about 1 to about 1000 and preferably from about 5 to about 200.

The line frequency f for casting of an aluminum alloy having a radius from about 1 inch to about 10 inches should be from about 3 to about 3000 hertz and preferably from about 9 to about 200 hertz.

The magnetic field strength which is a function of the line frequency and the melt radius should comprise for aluminum alloy casting from about 50 to 1500 gauss and preferably from about 100 to about 600 gauss.

The particular parameters employed can vary from metal system to metal system in order to achieve the desired shear rates for providing the thixotropic slurry.

Solidification zone as the term is used in this application refers to the zone of molten metal or slurry in the mold wherein solidification is taking place.

Magnetohydrodynamic as the term is used herein refers to the process of stirring molten metal or slurry using a moving or rotating magnetic field. The magnetic stirring force may be more appropriately referred to as a magnetomotive stirring force which is provided by the moving or rotating magnetic field of this invention.

The process and apparatus of this invention is applicable to the full range of materials as set forth in the prior art including, but not limited to, aluminum and its alloys, copper and its alloys, and steel and its alloys.

While the invention herein has been described in terms of a continuous or semi-continuous casting system, it can be used in conjunction with other types of casting systems, such as a static casting system, wherein magnetohydrodynamic stirring is utilized.

The patents, patent applications, and articles set forth in this specification are intended to be incorporated by reference herein.

It is apparent that there has been provided in accordance with this invention a process and apparatus having improved efficiency for making thixotropic metal slurries which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A process for improving efficiency in forming a semi-solid alloy slurry, said slurry comprising degenerate dendritic primary solid particles in a surrounding matrix of molten metal, said process comprising:

providing means for containing said molten metal, said containing means having a solidification zone;

electromagnetically mixing said molten metal and shearing dendrites formed in said solidification zone at a desired shearing rate;

said step of electromagnetically mixing comprising:

providing means for generating a moving magnetic field;

supplying current at a desired frequency to said magnetic field generating means;

generating said moving magnetic field with said magnetic field generating means, wherein the improvement comprises:

reducing the power consumption of said generating means;

said step of reducing said power consumption comprising controlling said frequency so that for said slurry having an effective cross section diameter in the range up to about 2 inches, said frequency is maintained in the range defined by the equation:

$$f = x\left\{\left[\frac{-578.7\times10^{-5}\,\text{in}^{-1}}{\Delta} - 148\,(\text{in}\cdot\text{sec})^{-1}\right]D + \left[\frac{1214.7\times10^{-5}}{\Delta} + 589\,\text{sec}^{-1}\right]\right\}$$

and for said slurry having said effective cross section diameter greater than about 2 inches, said frequency is maintained in the range defined by the equation:

$$f = Y\{[0.136\times10^{5}\,(\text{in}\cdot\text{sec}^{2})^{-1}(\Delta) - 68.7\,(\text{in}\cdot\text{sec})^{-1}]D + [-2.27\times10^{5}\,\text{sec}^{-2}(\Delta) + 478\,\text{sec}^{-1}]\}$$

where x=from about 0.75 to about 1.25 y=from about 0.5 to about 1.5

D = said effective cross section diameter $\Delta = \sigma \mu_o t^2$ $\sigma$ = electrical conductivity of said containing means $\mu_o$ = magnetic permeability of said containing means t = thickness of said containing means.

2. The process of claim 1 further comprising:

said step of providing magnetic field generating means comprising providing a multi-phase two pole induction motor stator;

said step of supplying current comprising supplying said current at said desired frequency to said stator;

wherein said step of controlling said frequency reduces the amount of said current required to produce said desired shearing rate whereby wasteful heating in said stator can be minimized.

3. The process of claim 1 further comprising:

cooling said molten metal to form a casting.

4. The process of claim 1 further comprising:

mixing said molten metal so that said shear rate is within the range of about 400 $sec^{-1}$ to about 1500 $sec^{-1}$.

5. The process of claim 4 further comprising:

mixing said molten metal so that said shear rate is within the range of about 500 $sec^{-1}$ to about 1200 $sec^{-1}$.

6. The process of claim 1 wherein the step of controlling said frequency comprises: controlling said frequency so that for said slurry having said effective cross section diameter in the range up to about 2 inches, said frequency being maintained in the range defined by the equation:

$$f = x\left\{\left[\frac{-578.7 \times 10^{-5}\ \text{in}^{-1}}{\Delta} - 148\ (\text{in} \cdot \text{sec})^{-1}\right] D + \left[\frac{1214.7 \times 10^{-5}}{\Delta} + 589\ \text{sec}^{-1}\right]\right.$$

where x = from about 0.8 to 1.2; and controlling said frequency so that for said slurry having said effective cross section diameter greater than about 2 inches, said frequency being maintained in the range defined by the equation:

$$f = y\{[0.136 \times 10^5\ (\text{in}\cdot\text{sec})^{-1}\ (\Delta) - 68.7\ (\text{in}\cdot\text{sec})^{-1}]D + [-2.27 \times 10^5\ \text{sec}^{-2}\ (\Delta) + 478\ \text{sec}^{-1}]\}$$

where Y = from about 0.75 to about 1.25.

* * * * *